US006340018B1

(12) United States Patent
Mattes

(10) Patent No.: US 6,340,018 B1
(45) Date of Patent: Jan. 22, 2002

(54) CONTROL VALVE FOR A FUEL INJECTION VALVE

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/642,773

(22) Filed: Aug. 22, 2000

(30) Foreign Application Priority Data

Aug. 25, 1999 (DE) ..... 199 40 292

(51) Int. Cl.[7] ..... F02M 37/04
(52) U.S. Cl. ..... 123/467; 123/506; 137/599.02
(58) Field of Search ..... 123/467, 506, 123/446, 447, 514; 137/599.11, 599.01, 599.02, 508; 239/96; 251/120, 129.15

(56) References Cited

U.S. PATENT DOCUMENTS 4,674,688 A * 6/1987 Kanesaka ..... 239/96
5,441,029 A * 8/1995 Hlousek ..... 239/96
5,664,545 A * 9/1997 Kato ..... 123/467
5,694,903 A * 12/1997 Ganser ..... 123/496
5,775,301 A * 7/1998 Ganser ..... 123/467
5,890,471 A * 4/1999 Nishmura ..... 123/467
6,085,719 A * 7/2000 Heinz et al. ..... 123/467
6,145,492 A * 11/2000 Lixl ..... 239/96
6,152,111 A * 11/2000 Potz et al. ..... 123/467

* cited by examiner

*Primary Examiner*—Thomas N. Moulis
(74) *Attorney, Agent, or Firm*—Ronald E. Greigg

(57) ABSTRACT

A control valve for a fuel injection valve, having a valve needle, which is displaceable in a control chamber that is provided with an inlet, an outlet, a valve needle seat, and a throttle seat. Various switching states that make different courses of the opening procedure of the nozzle needle, switched by the control valve, of the fuel injection valve possible. To that end, it is provided that a throttle ring is disposed on the valve needle and is provided with throttle bores, which extend parallel to the longitudinal axis of the valve needle, and that the dimensions of the throttle ring and valve needle are selected such that an outlet conduit is formed between the outer wall of the valve needle and the inner wall of the throttle ring.

3 Claims, 2 Drawing Sheets

CONTROL VALVE FOR A FUEL INJECTION VALVE

BACKGROUND OF THE INVENTION

The invention relates to a control valve for a fuel injection valve, having a valve needle that is displaceable in a control chamber that is provided with an inlet, an outlet, and a valve seat.

One such control valve is known from German Patent Disclosure DE 197 27 896 A1, for instance, and serves to bring about the opening of a nozzle needle of the injection valve in order to inject fuel into a cylinder of an internal combustion engine.

The nozzle needle is acted upon continuously with an opening pressure that seeks to lift the nozzle needle away from the associated valve seat. This opening force counteracts a closing force that is generated in a control pressure chamber. As long as the pressure in the control pressure chamber is kept at a high level, the closing force generated there is higher than the opening force acting on the nozzle needle, and thus the nozzle needle remains closed. Conversely, if the pressure in the control pressure chamber and consequently the closing force generated there drop, then the opening force succeeds in lifting the nozzle needle away from the valve seat. Fuel can now be injected.

The pressure in the control pressure chamber is controlled by the control valve, by opening or closing an outlet. If the medium, typically fuel, delivered to the control pressure chamber is dammed up by closure of the outlet, then a high pressure is generated in the control pressure chamber and keeps the nozzle needle in a closed state. If conversely the control valve opens the outlet, the pressure in the control pressure chamber drops, so that the nozzle needle can open.

OBJECT AND SUMMARY OF THE INVENTION

The control valve according to the invention has an advantage that at little expense, two different open states of the control valve can be attained, namely a partly open state, in which the fluid can escape from the control pressure chamber through the throttle bores, and a fully open state, in which both the throttle bores and the outlet conduit are open. The switchover between these two open states is effected solely by controlling the stroke of the valve needle. In this way, different types of injection can be attained.

In a preferred embodiment of the invention, the valve needle is provided with a needle head, which is larger than the inside diameter of the throttle ring, and the throttle ring is disposed between the needle head and the valve seat. Is this version, the valve needle serves not only for switching but also simultaneously as a guide for the throttle ring. The throttle ring is retained firmly in the axial direction between the needle head and the valve seat.

It is preferably also provided that a spring that urges the throttle ring away from the valve seat toward the needle head is disposed in the control chamber, and that a stop for the throttle ring is provided in the control chamber and limits the stroke of the throttle ring away from the valve seat. By means of the spring, the throttle ring can be displaced in an especially simple way in the interior of the control chamber, without requiring a separate actuating element controlled from outside. Also with this version, a partly open state of the control valve can be attained that is maximally independent of positional tolerances of the valve needle. Specifically, a tolerance range can be established within which the throttle ring is already lifted from the valve seat but has not yet struck the stop. Within the entire tolerance range, an outflow cross section through the throttle bores is obtained that is virtually independent of the position of the valve needle in this partly switched state.

The invention will be better understood and further objects and advantages thereof will become more apparent from the ensuing detailed description of a preferred embodiment taken in conjunction with the drawing.

DESCRIPTION OF THE PREFERRED EMBODIMENT

Figures 1, 2:
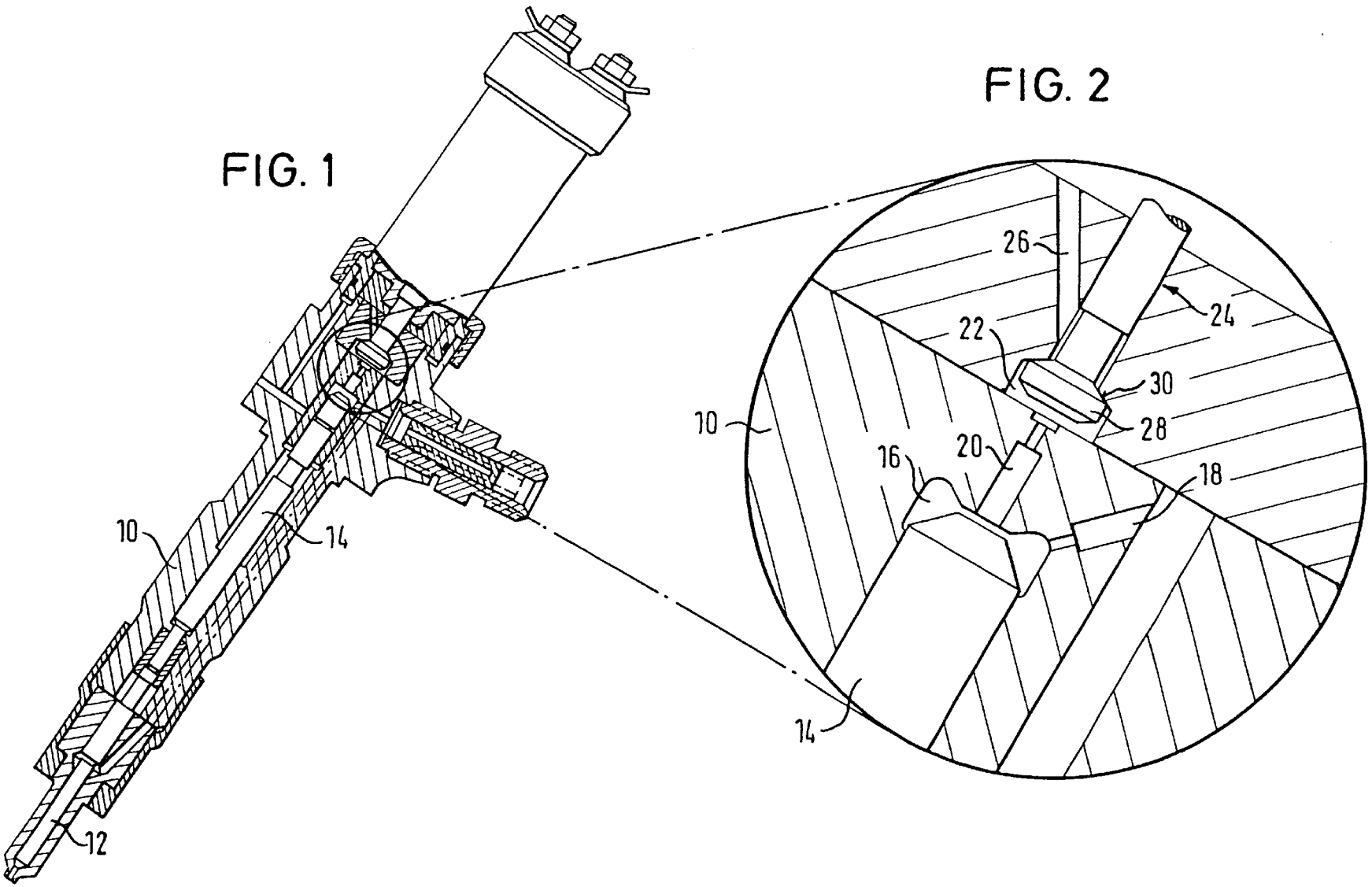
FIG. 1 is a schematic view of a fuel injection valve.
FIG. 2, in an enlarged view which shows a control valve according to the prior art, which can be used in the fuel injection valve of FIG. 1.

In FIG. 1, a conventional fuel injection valve with a control valve (see FIG. 2) is shown. The fuel injection valve has a valve body 10, in which a nozzle needle 12 is mounted displaceably. The nozzle needle 12 controls the injection of fuel into a cylinder of an internal combustion engine (not shown). The delivered fuel exerts an opening force on the nozzle needle 12 that seeks to displace both the nozzle needle and an actuating part 14, on which the nozzle needle 12 is braced, toward a control pressure chamber 16.

Fuel is also delivered to the control pressure chamber 16, and because of the pressure prevailing in the control pressure chamber 16, this fuel exerts a closing force on the actuating part 14. The fuel is furnished via an inlet 18, and an outlet 20 extends away from the control pressure chamber 16 and leads to a control chamber 22 of a control valve 24. For the control valve 24, the outlet 20 acts as an inlet, and an outlet 26 is provided through which the fuel can flow out of the control pressure chamber 16 and the control chamber 22.

In the control chamber 22, the control valve 24 has a valve needle 28, which cooperates with a valve seat 30. When the valve needle 28 is resting on the valve seat 30, the control valve 24 is closed, so that the fuel delivered to the control pressure chamber 16 via the inlet 18 is dammed up in the control pressure chamber. The high pressure generated in this way exerts a closing force on the actuating part 14 that is greater than the opening force acting on the nozzle needle 12. The fuel injection valve is consequently closed. Conversely, if the valve needle 28 is lifted from the valve seat 30, the fuel can flow out of the control pressure chamber 16 via the control chamber 22 and the outlet 26, so that the pressure in the control pressure chamber drops. The then-reduced closing force enables the opening of the nozzle needle, so that fuel is injected.

Figure 3:
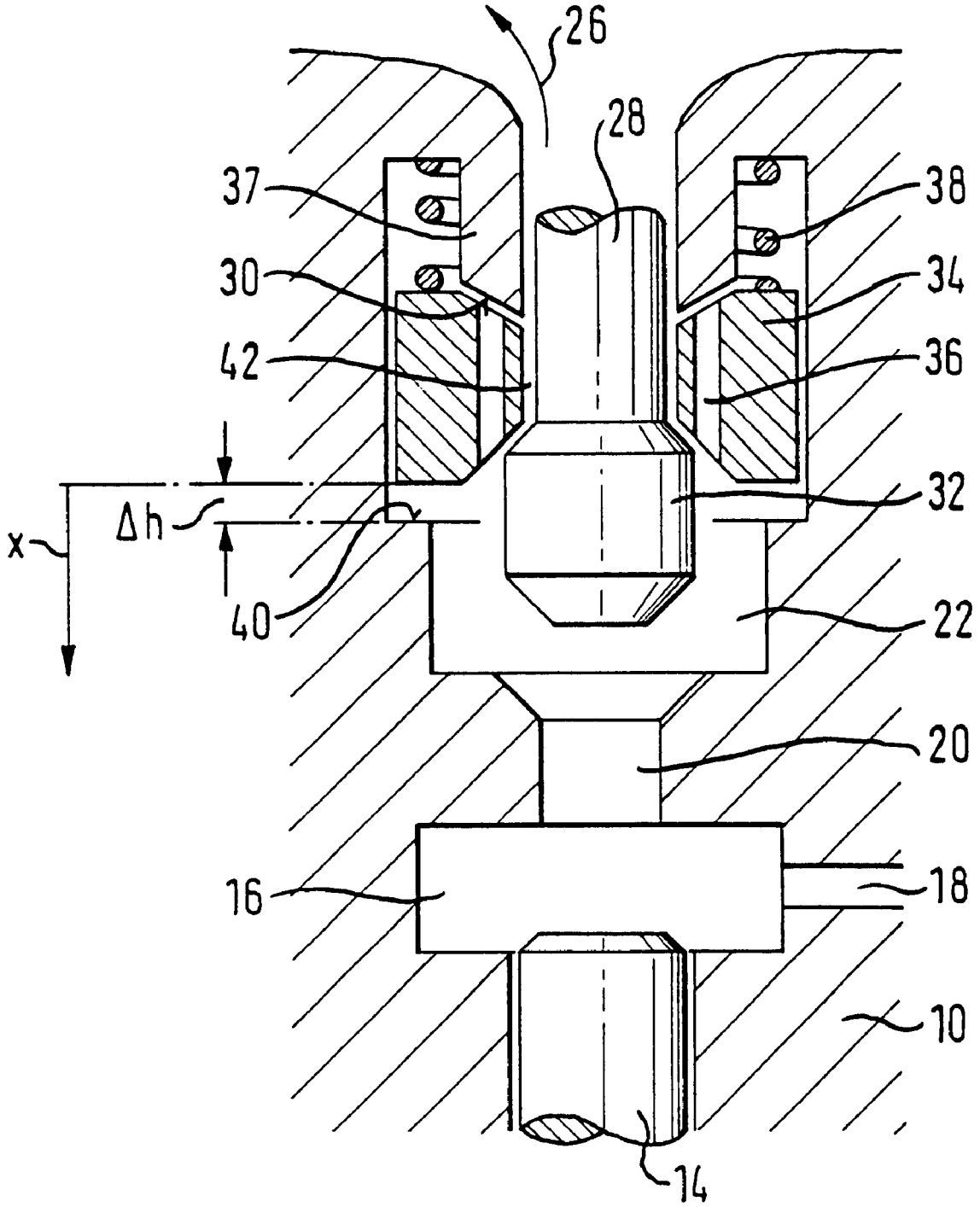
FIG. 3 is a cross-sectional view of a control valve of the invention.

The control valve of the invention will now be described, in conjunction with FIG. 3. The valve needle 28 is provided with a needle head 32. A throttle ring 34 is disposed displaceably on the valve needle 28 and is provided with a plurality of throttle bores 36. These throttle bores extend parallel to a longitudinal axis of the valve needle 28 and are disposed on a radius such that the bores can be closed by contact with a throttle seat 30'.

The throttle seat 30' is embodied on a cylindrical protrusion 37, around which a compression spring 38 is disposed. The compression spring 38 urges the throttle ring 34 away from the throttle seat 30', toward the needle head 32.

The control chamber 22 is provided with a shoulder 40, which, as a stop, is opposite an end of the throttle ring 34, on a side of the throttle ring remote from the compression spring 38, and limits the maximum stroke of the throttle ring.

The outer diameter of the valve needle 28 and the inner diameter of the throttle ring 34 are adapted to one another in such a way that between the valve needle 28 and the throttle ring 34, an outlet conduit 42 is formed through which the fuel can flow out of the control chamber 22 to the outlet 26. A bottom surface of the throttle ring between the bores 36 and the inner diameter of the throttle ring forms a valve seat 30 upon which the needle head 32 seats.

The control valve described has three different switching states. In a first state, the valve needle 28 is in its upper position, in which the valve needle head 32 presses the throttle ring 34 against the throttle seat 30', counter to the action of the spring 38. In this state, the control valve is closed, since the outlet conduit 42 is closed by contact of the needle head 32 with the throttle ring 34 and the throttle bores 40 are closed by contact with the throttle seat 30'.

The control valve has a partly open switching state, in which the valve needle 28, beginning at the closed state, is displaced by a stroke in the direction of the control pressure chamber 16 that is shorter than Δh. In this state, the throttle ring 34 continues to rest on the needle head 32 by the action of the spring 38, but is at a distance from the throttle seat 30'. Thus the fuel can escape from the control chamber 22 through the throttle bores 36 to the outlet 26.

Since only a comparatively small outlet cross section is available by way of the outlet bores 36, the pressure in the control pressure chamber 16 drops correspondingly slowly, and the nozzle needle 12 also begins to move slowly. This accordingly produces a slow increase in the nozzle needle stroke.

A third switching state is attained when the valve needle 28 executes a stroke in the direction of the control pressure chamber 16 that is greater than Δh. This long stroke cannot be executed by the throttle ring 34, since before that the throttle ring is resting on the stop 40. The outlet conduit 42 is thus opened. This outlet cross section is added to the outlet cross section furnished by the throttle bores 36, so that now a large outlet cross section is available, which assures a rapid pressure relief in the control pressure chamber 16.

The control valve described can be switched in such a way that the valve needle 28 executes a stroke greater than Δh for a brief period of time. The large outlet cross section that is then available assures a rapid relief of the control pressure chamber 16, so that the nozzle needle quickly lifts from the nozzle needle valve seat. In order to keep the nozzle needle suspended afterward, the outflow from the control pressure chamber 16 must be reduced, while the inflow via the inlet 18 is constant. To that end, the stroke of the valve needle 28 is adjusted to a value less than Δh, so that now only the outlet cross section determined by the throttle bores 36 is available. In this way, a boot injection can be attained.

The foregoing relates to a preferred exemplary embodiment of the invention, it being understood that other variants and embodiments thereof are possible within the spirit and scope of the invention, the latter being defined by the appended claims.

I claim:

1. A control valve for a fuel injection valve, comprising a valve needle (28), which is displaceable in a control chamber (22) that is provided with an inlet (20), an outlet (26), a valve needle seat (30), and a throttle seat (30'), a throttle ring (34) is disposed on the valve needle (28) and the throttle ring is provided with throttle bores (36), the throttle bores extend parallel to a longitudinal axis of the valve needle (28), and dimensions of the throttle ring (34) and valve needle (28) are selected such that an outlet conduit (42) is formed between an outer wall of the valve needle and an inner wall of the throttle ring.

2. The control valve according to claim 1, in which the valve needle (28) is provided with a needle head (32), which is larger than an inside diameter of the throttle ring (34), and that the throttle ring (34) is disposed between the needle head (32) and the throttle seat (30').

3. The control valve according to claim 1, in which a spring (38) urges the throttle ring (34) away from the throttle seat (30') toward the needle head (32) disposed in the control chamber (22), and that a stop (40) for the throttle ring (34) is provided in the control chamber (22) and limits a stroke of the throttle ring (34) away from the throttle seat (30').

* * * * *